US012660873B2

(12) United States Patent
Smith

(10) Patent No.: US 12,660,873 B2
(45) Date of Patent: Jun. 23, 2026

(54) SYSTEMS AND METHODS FOR CUSTOMIZING POCKETS

(71) Applicant: Perception01, LLC, Saratoga Springs, UT (US)

(72) Inventor: Denise D. Smith, Saratoga Springs, UT (US)

(73) Assignee: Perception01, LLC, Saratoga Springs, UT (US)

( * ) Notice: Subject to any disclaimer, the term of this patent is extended or adjusted under 35 U.S.C. 154(b) by 0 days.

(21) Appl. No.: 18/653,920

(22) Filed: May 2, 2024

(65) Prior Publication Data

US 2024/0365896 A1 Nov. 7, 2024

Related U.S. Application Data

(60) Provisional application No. 63/499,674, filed on May 2, 2023.

(51) Int. Cl.
*A41F 1/00* (2006.01)
*A41D 27/20* (2006.01)

(52) U.S. Cl.
CPC ..... *A41F 1/00* (2013.01); *A41D 27/20* (2013.01)

(58) Field of Classification Search
CPC ..... A41F 1/00; A41D 27/20
USPC ..... 2/249, 253
See application file for complete search history.

(56) References Cited

U.S. PATENT DOCUMENTS 3,551,963 A 1/1971 Mosher et al.
4,651,355 A * 3/1987 White ..... A41D 27/20 2/247
5,572,773 A * 11/1996 Bauer ..... A41F 1/002 24/303
5,946,732 A * 9/1999 Richards ..... A41D 27/20 2/244
6,035,449 A * 3/2000 Galler ..... A41D 27/20 2/249
6,233,747 B1 * 5/2001 Barker ..... A41D 27/20 2/247
7,774,864 B2 * 8/2010 Carlson ..... A41D 13/0012 2/249
D665,176 S 8/2012 Platt et al.
9,198,489 B2 12/2015 Romero et al.

(Continued)

FOREIGN PATENT DOCUMENTS

WO WO-8600505 A1 * 1/1986 ..... A41D 27/20
WO WO-9625065 A1 * 8/1996 ..... A41F 1/002
WO WO-2020049382 A1 * 3/2020 ..... A41F 1/002

OTHER PUBLICATIONS

SNAP—Female M Screw | FIDLOCK. https://www.fidlock.com/components/en/products/snap?v=109. Accessed Aug. 16, 2024, 3 pages.

(Continued)

*Primary Examiner* — Tajash D Patel
(74) *Attorney, Agent, or Firm* — Alliance IP, LLC

(57) ABSTRACT

An apparatus comprising a base comprising a platform; at least one first fastener to removably couple the platform to a pocket; and at least one second fastener to removably couple the platform to an item of apparel, wherein the at least one second fastener is to interface with an inner surface of the item of apparel to hold at least a portion of the platform against an outer surface of the item of apparel.

20 Claims, 19 Drawing Sheets

(56) References Cited

U.S. PATENT DOCUMENTS

| | | | | |
|---|---|---|---|---|
| 9,913,503 | B2 * | 3/2018 | Rapp | A41D 27/202 |
| 2019/0328068 | A1 * | 10/2019 | Reiter | A44B 17/0041 |
| 2021/0307495 | A1 * | 10/2021 | Schori | A41F 1/002 |
| 2023/0130028 | A1 * | 4/2023 | Grabowski | A44B 17/0094 24/303 |

OTHER PUBLICATIONS

SNAP—Female S Screw Cap | FIDLOCK. https://www.fidlock.com/components/en/products/snap?v=77. Accessed Aug. 16, 2024, 3 pages.

SNAP—Female S Screw Cap | FIDLOCK. https://www.fidlock.com/components/index.php/en/products/snap?v=77. Accessed Aug. 16, 2024, 3 pages.

SNAP—Male S Screw High | FIDLOCK. https://www.fidlock.com/components/en/products/snap?v=64. Accessed Aug. 16, 2024, 3 Pages.

* cited by examiner

SYSTEMS AND METHODS FOR CUSTOMIZING POCKETS

RELATED APPLICATION

This application claims benefit under 35 U.S.C. § 119 (e) of U.S. Provisional Application Ser. No. 63/499,674, entitled "SYSTEMS AND METHODS FOR CUSTOMIZING POCKETS" filed May 2, 2023. The disclosure of this application is hereby incorporated by reference herein.

BACKGROUND

A pocket may include a small area in an apparel item that is designed for carrying small articles. In many instances, a pocket is sewn into the apparel item or otherwise permanently attached to the apparel item.

DETAILED DESCRIPTION

Figure 1A:
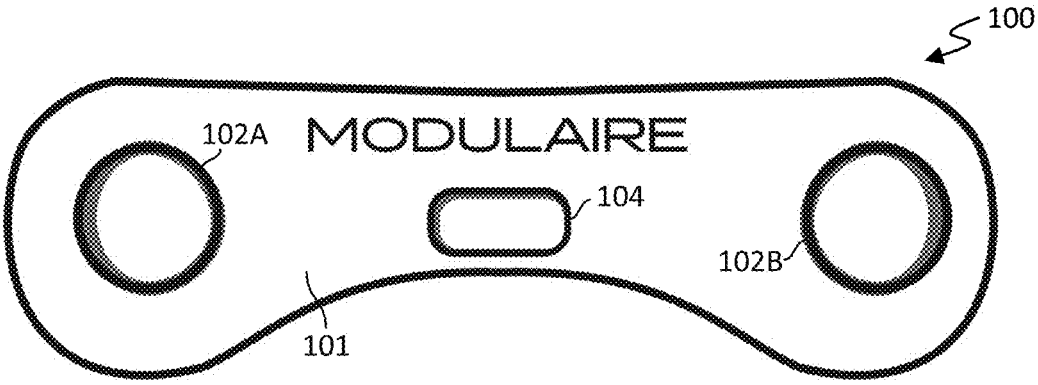
FIG. 1A illustrates a front view of a pocket base, in accordance with any of the embodiments disclosed herein.

Pockets are used ubiquitously to provide storage for various items such as phones, keys, wallets, credit cards, coins, writing utensils, makeup, or lip balm among other things. Pockets may also be used to exhibit style, provide ventilation, or for other purposes. As used herein, a pocket may refer to an apparel item that is used to at least partially enclose an object placed therein and may refer to conventional pocket styles (e.g., shirt or pants pockets), pouches, pods, small bags, wallets, lanyards, fanny packs, or the like. Apparel may refer to clothing worn on the legs (e.g., pants, shorts, leggings, skirts, etc.) and/or upper body (e.g., shirts, blouses, jackets, vests, etc.) or accessories (e.g., hats, scarves, gloves, shoes, belts, socks, bags, purses, pet items, etc.).

Despite the numerous advantages of pockets, various apparel styles may be sold without pockets (or without adequate pockets) (e.g., to reach a lower price point). When pockets are included on apparel, the pockets are typically attached permanently to the apparel and are not removeable. For example, a pocket may be sewn in place during manufacturing of the clothing or other apparel. Accordingly, if a particular item of apparel in use by a person does not have the desired pocket combination (e.g., in terms of pocket style, size, placement, or function) for an activity to be performed, the person may have to swap the item for a different item of apparel or carry an extra item of apparel (e.g., a bag) with the desired pocket combination. If an item of apparel includes an undesired pocket, the pocket is generally not removable (at least in an aesthetically pleasing fashion) and the cost of the pocket is still factored into the purchase price of the item. The permanence of the pocket also prevents a person from detaching the pocket and its contents from the item of apparel.

Interchangeable pockets may alleviate various drawbacks associated with apparel with permanent pockets and/or inadequate pockets. However, conventional mechanisms for interchangeable pockets tend to be permanently affixed to the apparel item. For example, such mechanisms may include a portion that is sewn onto the apparel item, or utilize a Velcro® hook and loop system, snapping elements, or zipper attachment, resulting in the item being designed with the hook or loop tape on the outside or having a system permanently sewn onto the garment. Thus, the item must be worn with a precisely sized pocket in the intended space to avoid visible exposure of the attachment mechanism on the item. Other fasteners may be more elaborate and may include multiple fastening elements in the item for the pocket, such as multiple eyelet holes in the apparel in which a fabric strip or ribbon is threaded through the holes and may be changed to a different hole system within the garment.

Such a configuration presents a time inconvenience for a user to unthread the pocket placement and replace the pocket with a new threaded tie system and new pocket position and may also result in holes in the item that are see-through to the body when the item is worn.

Various embodiments of the present disclosure provide an interchangeable (also referred to as modular) pocket system comprising a pocket base that may be removably attached to an apparel item. As one example, the pocket base may include magnet assemblies that include a magnet, a pin, and a clasp. The pins of the magnet assemblies may be placed through an item and the clasps may be secured to the pins to hold the pocket base against the item. The pocket base may then serve as an interface to attach an interchangeable pocket to the apparel item. In various embodiments, the magnets of the magnet assemblies may mate with magnets affixed to an interchangeable pocket, thus mounting the interchangeable pocket onto the pocket base and affixing the interchangeable pocket to the apparel item.

The interchangeable pockets may have any suitable design, style, fabric, shape, color, or trim. As the pocket base is removably attached to an apparel item, it may be repositionable on the same item or may be removed from the item and placed on another item, facilitating flexible usability across a number of apparel items.

Any of the various embodiments described herein may provide one or more advantages. For example, an interchangeable pocket system may provide a user with a high degree of customization over the style and size of pockets attached to apparel items worn or otherwise employed by the user and may allow a user to conveniently add to or change aesthetic design elements with respect to the apparel items. This may allow consumers to adapt their clothing and accessories in an enjoyable manner by re-designing or re-styling apparel. For example, a user may purchase basic apparel items and then customize their wardrobe using various interchangeable pockets.

In addition to aesthetic customization, apparel items may also be customized for utility using interchangeable pockets. For example, an interchangeable pocket affixed to an apparel item may alleviate the need to carry an extra bag or carrying case to access items that can be placed in the interchangeable pocket. An interchangeable pocket may be added to an apparel item that was not manufactured with a pocket. An interchangeable pocket and its contents may be removed from the pocket base and transported with the user (e.g., to a bathroom, into a store, around an office, etc.), thus the pocket may function as a separate bag or pouch when removed.

Interchangeable pockets may also result in time savings, as a pocket may be quickly swapped or added to an apparel item to change the look of an outfit, avoiding the need to change multiple items of or a whole outfit. The interchangeable pocket and its contents may also be quickly removed from one apparel item and placed onto another apparel item, thus saving the time required to empty the contents of a pocket and move the items to another pocket.

The interchangeable pocket systems described herein may also have significant sustainability benefits. For example, a user that desires to reduce their environmental footprint may purchase a set of basic apparel items and utilize the interchangeable pockets to significantly increase the flexibility of their wardrobe and longevity of individual apparel items through repurposing of the basic apparel to achieve a longer apparel life cycle, thus reducing waste and pollution associated with the manufacturing and disposal process. Interchangeable pockets may also allow for smaller wardrobes, thus decreasing the closet space required to store one's apparel and reducing the amount of luggage needed for travel.

Figure 1B:
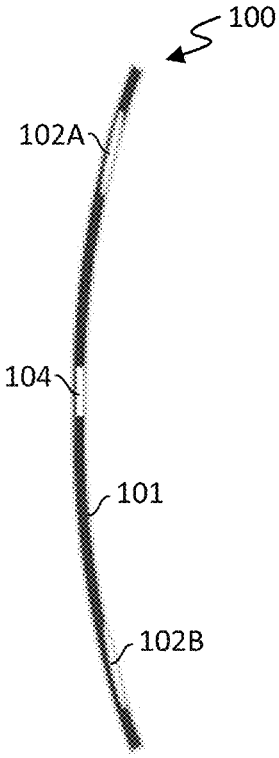
FIG. 1B illustrates a top view of the pocket base, in accordance with any of the embodiments disclosed herein.
Figure 1C:
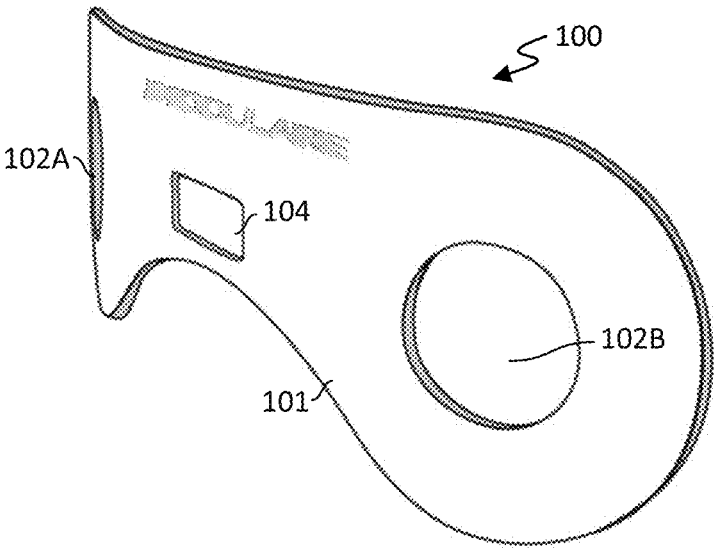
FIG. 1C illustrates a perspective view of the pocket base, in accordance with any of the embodiments disclosed herein.

FIG. 1A illustrates a front view of a pocket base 100, FIG. 1B illustrates a top view of the pocket base 100, and FIG. 1C provides a perspective view of the pocket base 100, in accordance with any of the embodiments disclosed herein. In the depicted embodiment, the pocket base is relatively thin and includes a platform 101 and a plurality of apertures 102A, 102B, and 104 formed therein. In this embodiment, the pocket base 100 is symmetrical about a plane that passes through the middle of the pocket base 100. Thus, as shown, the apertures 102A and 102B may be the same size and may be the same distance from the middle of the pocket base 100 and aperture 104 may be centered about the middle of the pocket base 100.

In the embodiment depicted, the apertures 102A and 102B are formed on either side of the pocket base 100 and are generally centered within the surrounding material of the pocket base 100. In the embodiment depicted in FIG. 1A, the left and right sides and the top and bottom sides are each curved, with the middle portion of the bottom exhibiting the most curvature, and the top exhibiting the least curvature. In other embodiments, any of these sides (or one or more portions thereof) may be straight (with straight or rounded edges at the intersection of two sides) or have different curvature.

As depicted in FIG. 1B, the pocket base 100 exhibits curvature along its length from one side of the pocket base to the other side (e.g., from the left side to the right side as shown in FIG. 1A which may correspond to the curvature from the top to the bottom of FIG. 1B). The curvature may promote comfort when the pocket base 100 is attached to apparel or an accessory that is worn against a body part, such as a leg, waist, forehead, or other body part exhibiting curvature. The pocket base 100 may have any suitable curvature. In some embodiments, the curvature along the length may range from no curve (e.g., where shape along the length of the pocket base is a straight line) to a curve in which the length of the pocket base 100 forms up to a quarter of the circumference of a circle (where the shape of the pocket base is substantially coincident with a portion of the circumference of a circle).

The platform 101 may comprise any suitable material, such as one or more of plastic, nylon, polycarbonate, metal filaments, cut and sewn fabrics, or other suitable material. The platform 101 may be formed in any suitable manner, such as through three dimensional (3D) printing, a molding process, or cut and sew fabrication. In some embodiments, the platform 101 may comprise a coating on its outer surfaces that provides a desired aesthetic (e.g., a dull look, a shiny look, a particular color, a metallic finish, etc.).

In various embodiments, the material choice and or dimensions of the platform 101 may exhibit a suitable balance of sturdiness (e.g., to provide support for the weight of a corresponding interchangeable pocket and contents placed therein) and flexibleness (e.g., to adapt to the curvature of the particular item that the pocket base 100 is affixed to). For example, to achieve a suitable balance between sturdiness and flexibleness, an average thickness of the platform 101 may be between ⅛ inch and ¼ inch. In one embodiment, the average thickness of the pocket base 100 may be substantially 3/16 inch.

The apertures 102A and 102B are on opposite halves (e.g., left half, right half in the front view of FIG. 1A) of the platform 101 and each have a circular footprint. The aperture 104 is shown as an eyelet in the horizontal center of the platform 101. Although particular numbers, locations, sizes, and shapes of apertures are depicted, other embodiments may vary therefrom. For example, a pocket base may include one or more additional apertures 102 or 104 and these apertures may be positioned at any suitable locations of the platform 101. As another example, one or more of the depicted apertures may be omitted.

Figure 2:
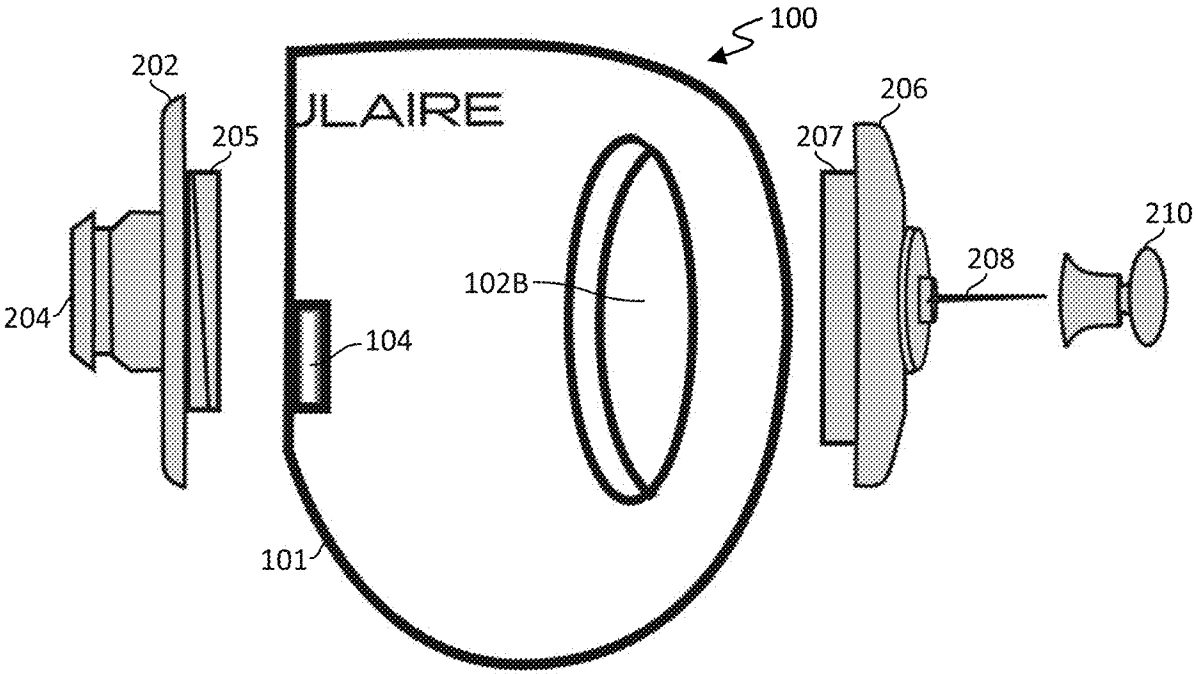
FIG. 2 illustrates a side view of the pocket base with a magnet assembly, in accordance with any of the embodiments disclosed herein.

FIG. 2 illustrates a side view of the pocket base with a magnet assembly, in accordance with any of the embodiments disclosed herein. The magnet assembly may include a first portion 202, a second portion 206, and a clasp 210. The first portion 202 includes a magnet 204 (e.g., with a male interface) on one side and a fastening mechanism 205 on the other side. The second portion 206 may include a fastening mechanism 207 on one side and a pin 208 on the other side. The fastening mechanism 205 may mate with the fastening mechanism 207 to secure the first portion 202 to the second portion 206. At least a portion of the fastening mechanism 205 and/or fastening mechanism 207 may be placed through aperture 102B when the first portion 202 is attached to the second portion 206. In a particular embodiment, the fastening mechanism 205 and the fastening mechanism 207 includes threads, such that the second portion 206 may be screwed onto the first portion 202 (or vice versa). In other embodiments, the first portion 202 may be attached to the second portion 206 in any suitable manner, such as through a snap, by adhesive, or in other suitable manner. In this manner, the portions of the magnet assembly are attached to each other and to the pocket base 100.

The second portion 206 also includes pin 208, which may be placed through material of an apparel item (e.g., from an outer surface up to and potentially beyond an inner surface of the apparel item). The clasp 210 may be placed on the other side (e.g., the inner side) of the material and around the pin 208 to secure the second portion 206 (and the platform 101 and first portion 202) to the item (e.g., such that at least a portion of the platform 101 is held against the outer surface of the apparel item). A similar magnet assembly may be placed through aperture 102A and secured to the item in like manner. When a user desires to reposition the pocket base 100 or move the pocket base 100 to a new item, the clasps 210 may be removed from the pins 208 and then reattached to the pins once the pins 208 have been placed through the material of the item at the desired positions. Any suitable clasps may be used, such as flat back clasps or a clasp having a curved edge (e.g., on a side that may contact a body of a person wearing the apparel item with the pocket base 100).

The magnet 204 may interface with an appropriately sized magnet on the back of an interchangeable pocket (as will be described in more detail below) to secure the interchangeable pocket to the pocket base 100 and thus to the item to which the pocket base 100 is affixed. While various embodiments herein focus on a magnetic attachment between the pocket base 100 and the interchangeable pockets, other embodiments may use any suitable attachment mechanisms to sucre the pocket base 100 to interchangeable pockets, such as hook and loop, magnetic clasps, clips, buttons, pin clasp fasteners, or other suitable attachment mechanisms.

Figure 3:
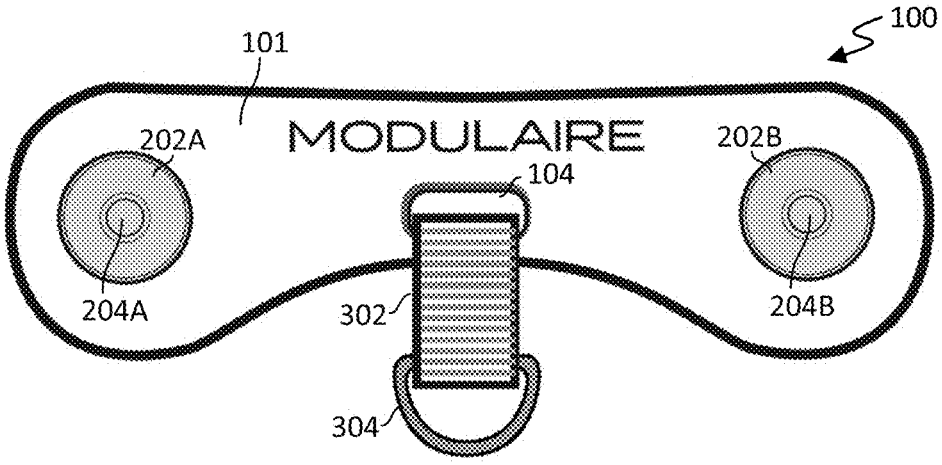
FIG. 3 illustrates a front view of the pocket base with magnet assemblies and an attached dee ring, in accordance with any of the embodiments disclosed herein.

FIG. 3 illustrates a front view of the pocket base 100 with magnet assemblies and an attached dee ring 304, in accordance with any of the embodiments disclosed herein. In this view, first portions 202A and 202B and magnets 204A and 204B are visible (as the magnet assemblies have been placed into the corresponding apertures).

Tape 302 and an attached dee ring 304 are attached to the pocket base 100 through the aperture 104. In various embodiments, any suitable hardware (e.g., a dee ring, a lobster claw clasp, etc.) may be attached to the pocket base in order to attach to other fasteners to hold keys, a card holder, or other small items.

Figure 4:
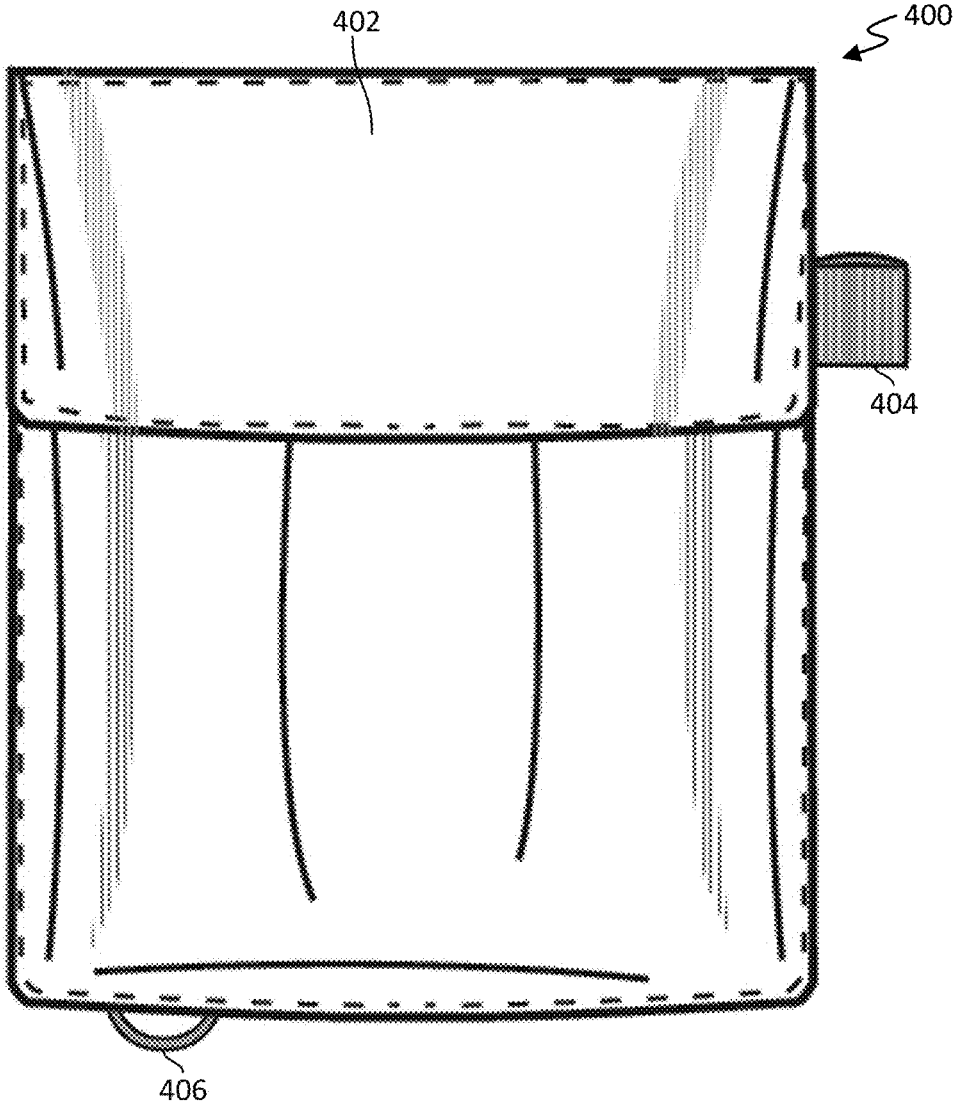
FIG. 4 illustrates a front view of an interchangeable pocket, in accordance with any of the embodiments disclosed herein.

FIG. 4 illustrates a front view of an interchangeable pocket 400, in accordance with any of the embodiments disclosed herein. Pocket 400 includes a front flap 402, a tab 404, and a dee ring 406.

The front flap 402 may be opened to expose the pocket in order to place one or more items therein and then closed over the pocket. The tab 404 may extend outward from the border of the pocket and may comprise a trim tab for pulling the pocket 400 to release it from the pocket base 100 to change or remove the pocket 400.

The interchangeable pocket 400 may comprise any suitable material, such as nylon, denim, cotton, polyester, or other suitable material. In various embodiments, the material may be relatively lightweight. The interchangeable pocket 400 may be used to hold any suitable items, such as a phone or a wallet.

In various embodiments, any suitable hardware (e.g., a dee ring, a lobster claw clasp, etc.) may be attached to the pocket 400 in order to attach to other fasteners to hold keys, a card holder, or other small items.

Figure 5:
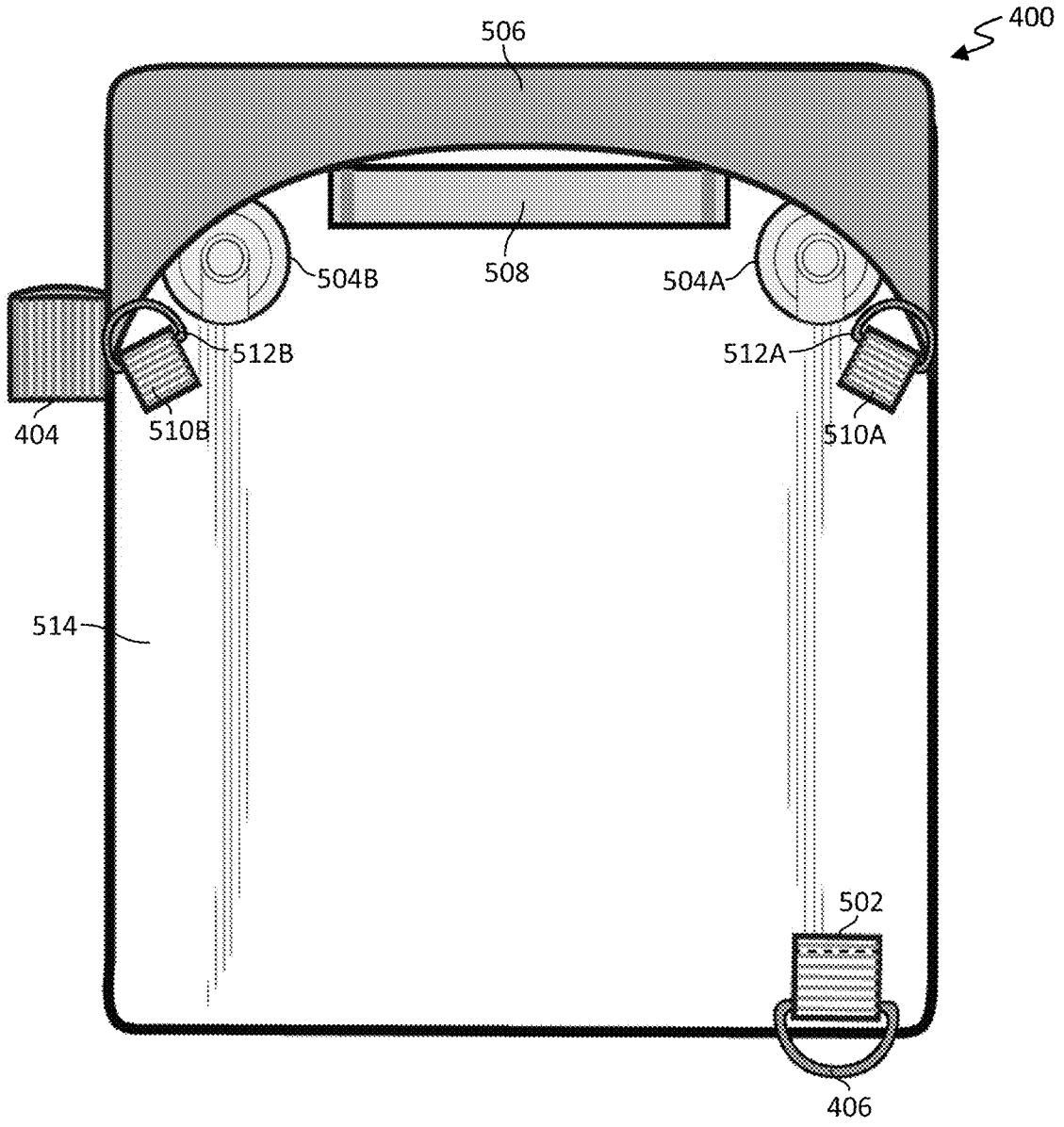
FIG. 5 illustrates a back view of the pocket, in accordance with any of the embodiments disclosed herein.

FIG. 5 illustrates a back view of the pocket 400, in accordance with any of the embodiments disclosed herein. In this view, pocket 400 includes a tape 502 coupling the dee ring 406 to the pocket 400. Pocket 400 also includes tapes 510A and 510B coupling dee rings 512A and 512B to the pocket 400. In some embodiments, tapes 510A and 510B may be attached to the pocket 400 via any suitable manner (e.g., sewn on, glued on, etc.). In some instances, the dee rings 512A and 512B may be utilized to attach the pocket 400 to a belt, scarf, or other item (for example, the item may be threaded through the loops). In other embodiments, the pocket 400 may, on its back side, include a fabric loop to attach to a belt, scarf, or other item.

Pocket 400 also includes a back vent 506 (also referred to as a hood) that may be wrapped over the pocket base 100 when the pocket is attached thereto in order to conceal the pocket base 100. In a particular embodiment, the back vent 506 is sewn (or otherwise attached) onto the back side 514 of the pocket 400. In some instances, the back vent 506 may be under tension, so as to pull the pocket base 100 closer to the pocket 400, facilitating concealment of the pocket base 100.

The pocket 400 may also include a back loop 508 attached to the back side 514. The loop 508 may be used as a handle when the pocket 400 is removed from the pocket base 100. For example, the pocket 400 may be used as a makeup bag, a to-go bag, or other suitable apparatus.

Pocket 400 may also include magnets 504A and 504B to interface with the magnets 204A and 204B. For example, magnets 504A and 504B may include female interfaces to mate with the male interfaces of magnets 204A and 204B. In various embodiments, the magnets may be relatively thin (e.g., less than 10 millimeters in thickness), creating a sleek, relatively seamless attachment interface. In some instances, the magnets 504A and 504B may be concealed within a wall, side, back, or flap of the pocket 400.

Figure 7:
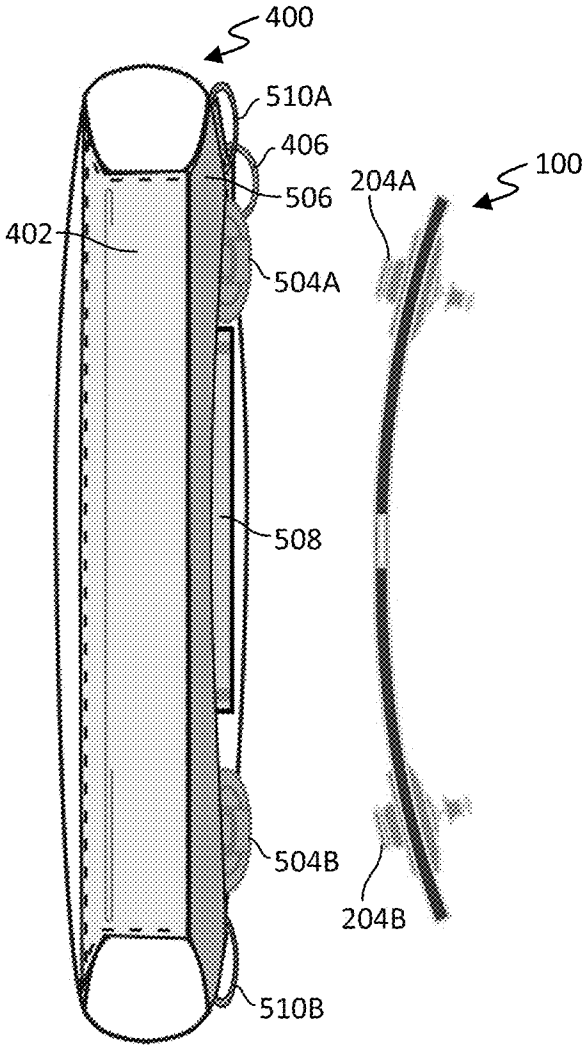
FIG. 7 illustrates a top view of the pocket and the pocket base, in accordance with any of the embodiments disclosed herein.
Figure 6:
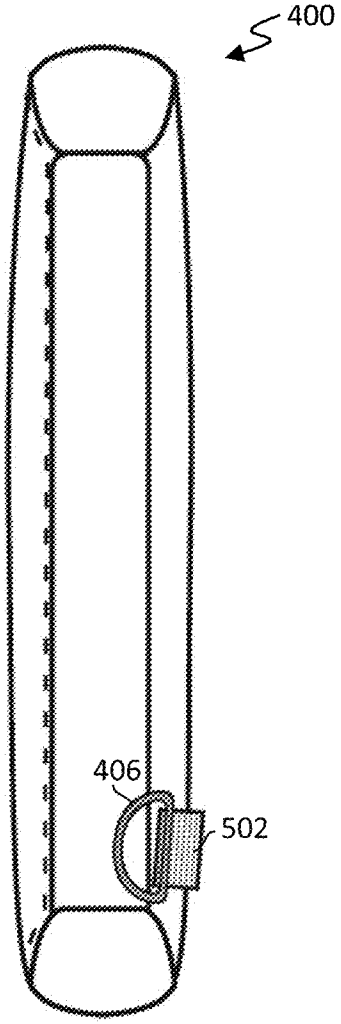
FIG. 6 illustrates a bottom view of the pocket, in accordance with any of the embodiments disclosed herein.

FIG. 6 illustrates a bottom view of the pocket, in accordance with any of the embodiments disclosed herein. FIG. 7 illustrates a top view of the pocket and the pocket base, in accordance with any of the embodiments disclosed herein. In addition to illustrating components previously described, FIG. 7 also depicts alignment of the magnets 504A and 504B of the pocket 400 with magnets 204A and 204B of the pocket base 100 (e.g., prior to attachment of the pocket 400 to the pocket base 100).

Figure 8:
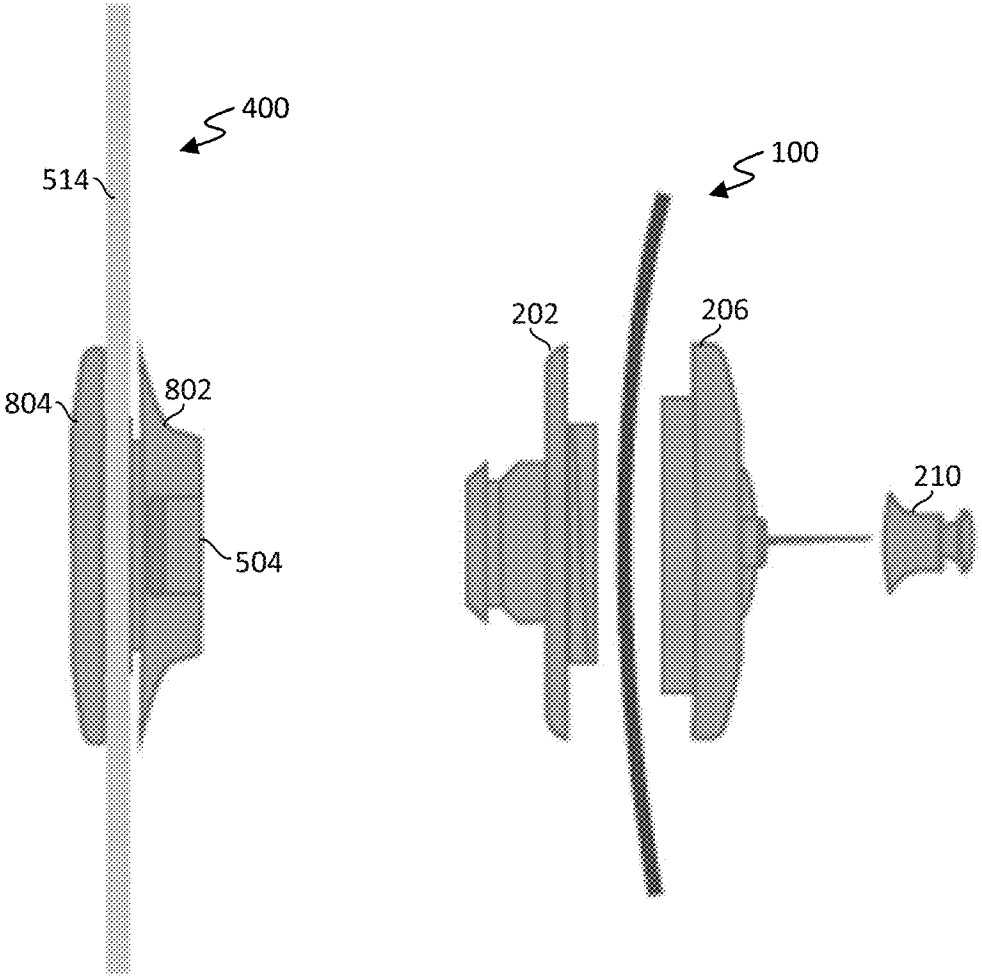
FIG. 8 illustrates a magnet assembly of the pocket and a magnet assembly of the pocket base, in accordance with any of the embodiments disclosed herein.

FIG. 8 illustrates a magnet assembly of the pocket 400 and a magnet assembly of the pocket base 100, in accordance with any of the embodiments disclosed herein. The magnet assembly of the pocket base 100 may be assembled in a manner similar to that described above. The magnet assembly of the pocket includes a first portion 802 including the magnet 504 and a second portion 804. In various embodiments, the first portion 802 is attached to the second portion 804 through an aperture in the back side 514 of the pocket 400. For example, the first portion 802 may be screwed into the second portion 804 or vice versa. In other embodiments, the portions may be attached in other suitable manner (e.g., similar to that described above with respect to the magnet assembly of the pocket base 100 or in other manner).

Although various embodiments herein focus on fasteners comprising magnets as the attachment mechanism between the pocket 400 and the pocket base 100, in other embodiments, any suitable fasteners may additionally or alternatively be included on the pocket 400 or pocket base 100 to provide the attachment. For example, such fasteners may include hook and loop elements, clips, magna pins, snap elements, snap base fasteners, or friction-based fasteners.

Similarly, although various embodiments herein focus on fasteners comprising a pin and/or clasp as the attachment mechanism between a pocket base 100 and an apparel item, any other suitable fasteners (including any of the fasteners mentioned herein) may be used in other embodiments. For example, the fastener may include a magnet attached to the platform 101 and another magnet that goes on the inside of the apparel item and mates with the magnet on the platform 101. As another example, the fastener may include a multi-prong fastener that is attached to the platform. The prongs may pass through the material of the apparel item and then may be bent to affix the platform to the apparel item. Although the depicted embodiments show the fasteners used to attach the pocket base 100 to the apparel item (e.g., the pins and clasps) as integrated with (e.g., part of the same assembly as) the fasteners (e.g., magnets) used to attach the interchangeable pocket to the pocket base, in other embodiments, these fasteners may be separate.

Figure 9:
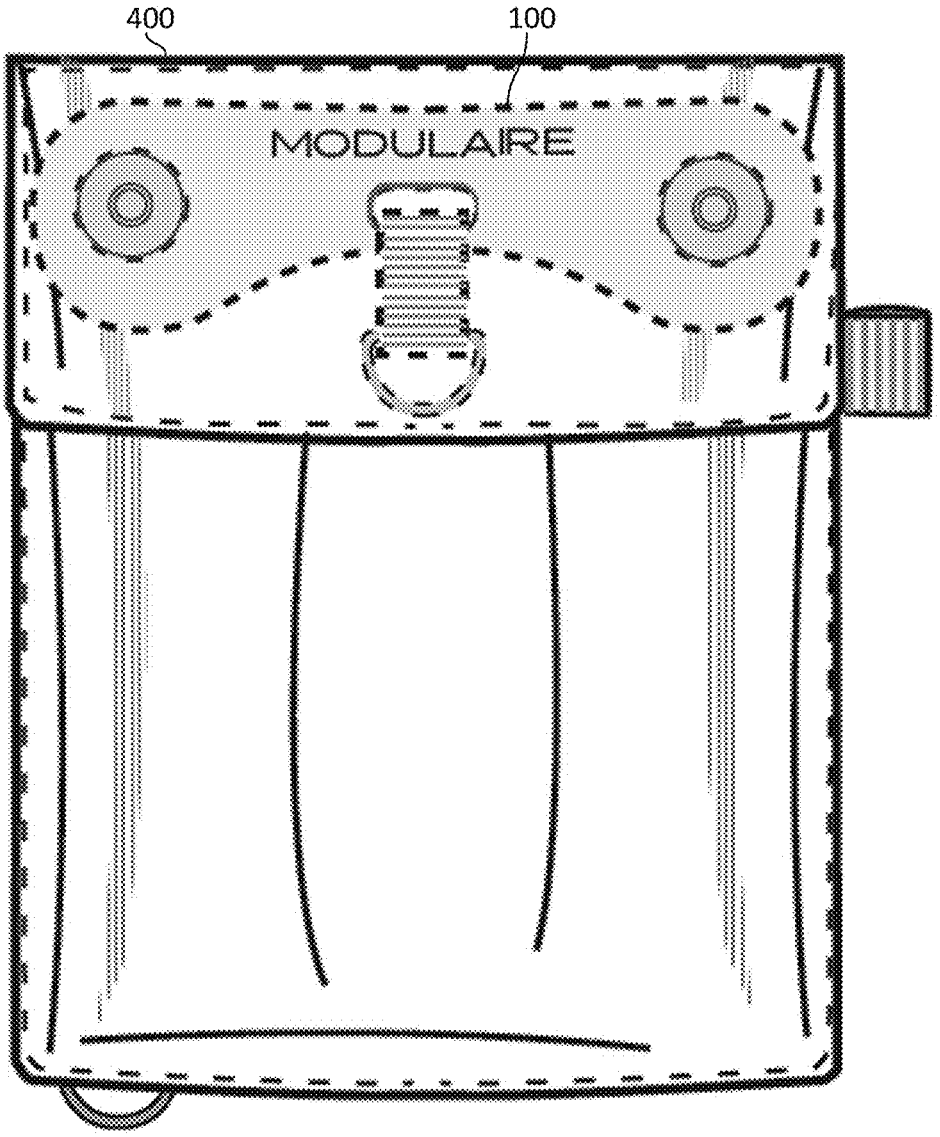
FIG. 9 illustrates a front view of the pocket attached to the pocket base, in accordance with any of the embodiments disclosed herein.

FIG. 9 illustrates a front view of the pocket 400 attached to the pocket base 100, in accordance with any of the embodiments disclosed herein. The pocket base 100 is shown in dashed lines as it is behind the pocket and would generally not be visible in this view (unless the material of the pocket was transparent). Upon attachment, the respective magnets of the pocket 400 and pocket base 100 may be at least substantially aligned.

Figure 10C:
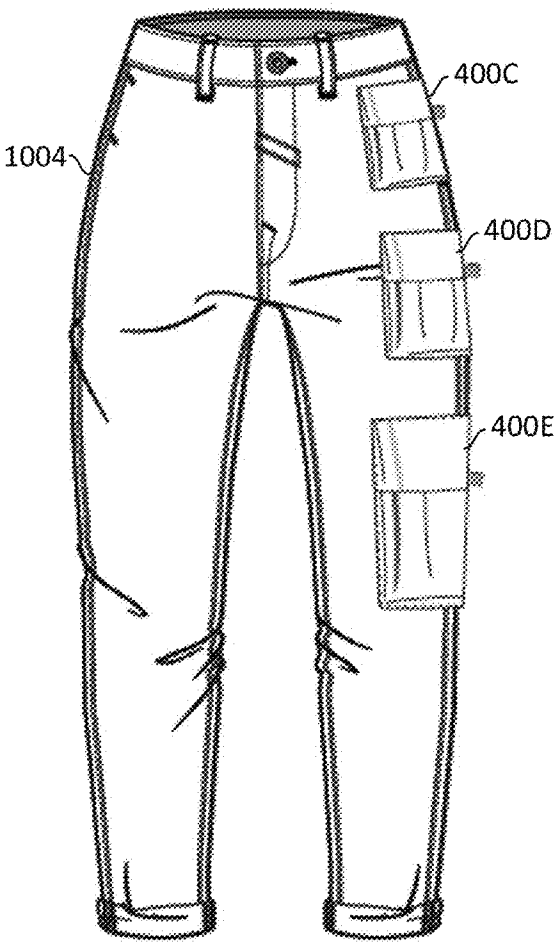
FIGS. 10A-10C illustrate various pocket bases and pockets attached to apparel, in accordance with any of the embodiments disclosed herein.
Figure 10B:
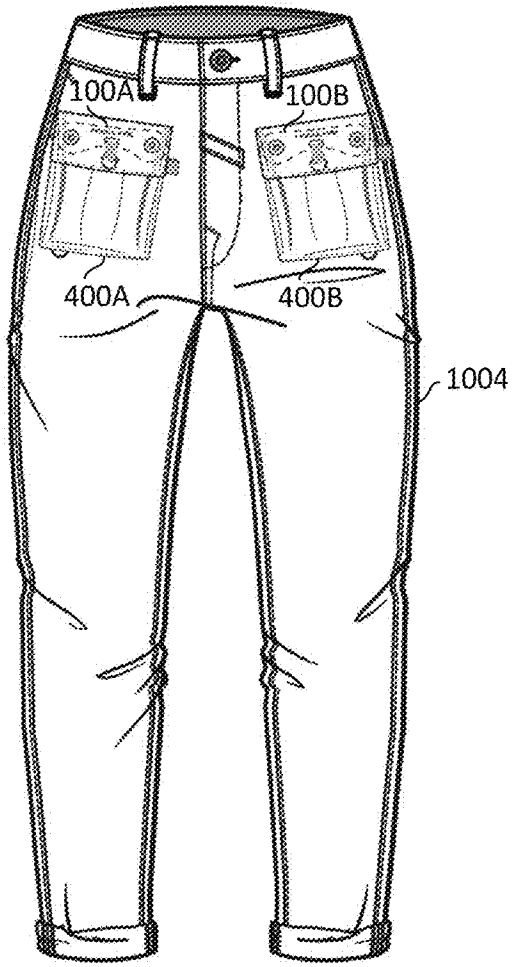
Figure 10A:
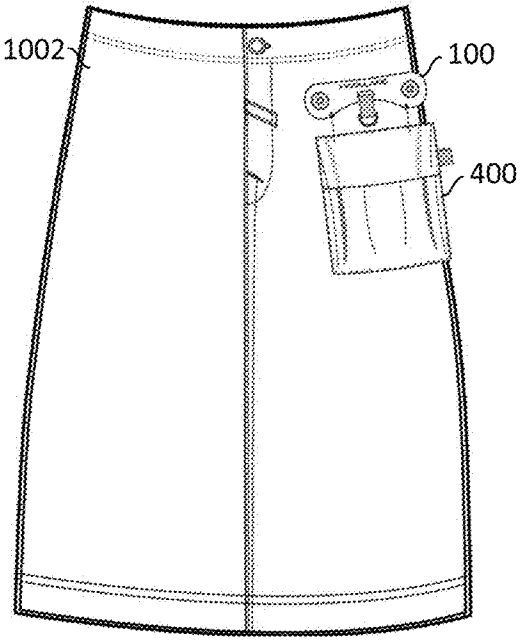

FIGS. 10A-10C illustrate various pocket bases and pockets attached to apparel, in accordance with any of the embodiments disclosed herein. In FIG. 10A, the pocket base 100 is attached to a skirt 1002. For example, pins 208 of the pocket base 100 may be placed through the material of the front of the skirt and clasps 210 may be placed on the opposing side of the front of the skirt 1002 and attached to the pins 208 to secure the pocket base 100 to the skirt 1002. In the embodiment depicted, the pocket 400 is not yet attached to the pocket base, but may be attached by aligning the magnets of the pocket 400 with the magnets of the pocket base 100.

In FIG. 10B, two pocket bases 100A and 100B have been attached to jeans 1004. Pockets 400A and 400B have been attached to pocket bases 100A and 100B (with the pocket bases 100A and 100B shown in dashed lines to indicate that they are behind the pockets and would not be visible in this configuration). In FIG. 10C, three pocket bases (not shown) have been attached to different locations of the same jeans 1004. Pockets 400C, 400D, and 400E have been attached to these pocket bases. In this embodiment, the pockets are the same style, but are different sizes. In various embodiments, one or more of the pocket bases could also have a size that is different from a size of one or more of the other pocket bases. In various embodiments, any of the pockets 400 shown could be easily removed and replaced with another interchangeable pocket (various examples of which will be illustrated herein).

As shown, the attachment interface between a pocket base 100 and an interchangeable pocket 400 is essentially indistinguishable from the interface between a pocket that is permanently attached to apparel.

Figure 11:
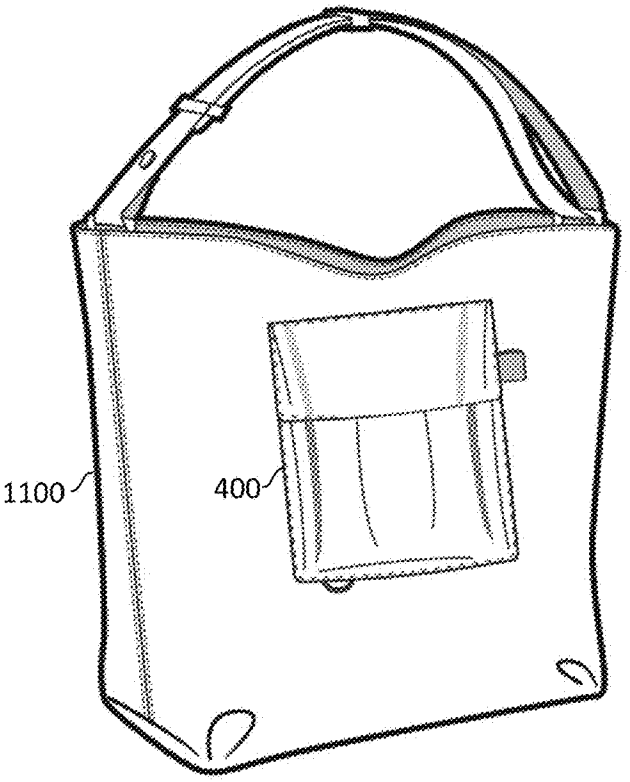
FIG. 11 illustrates an interchangeable pocket attached to a handbag, in accordance with any of the embodiments disclosed herein.

FIG. 11 illustrates an interchangeable pocket 400 attached to a handbag 1100, in accordance with any of the embodiments disclosed herein. Although not visible, the interchangeable pocket 400 may be attached to a pocket base 100 that is attached to the handbag's front wall. For example, pins 208 may be placed through the bag's front wall and clasps 210 may be placed on the backside of the bag's front wall and attached to the pins 208 to secure the pocket base 100 to the handbag 1100.

Figure 12:
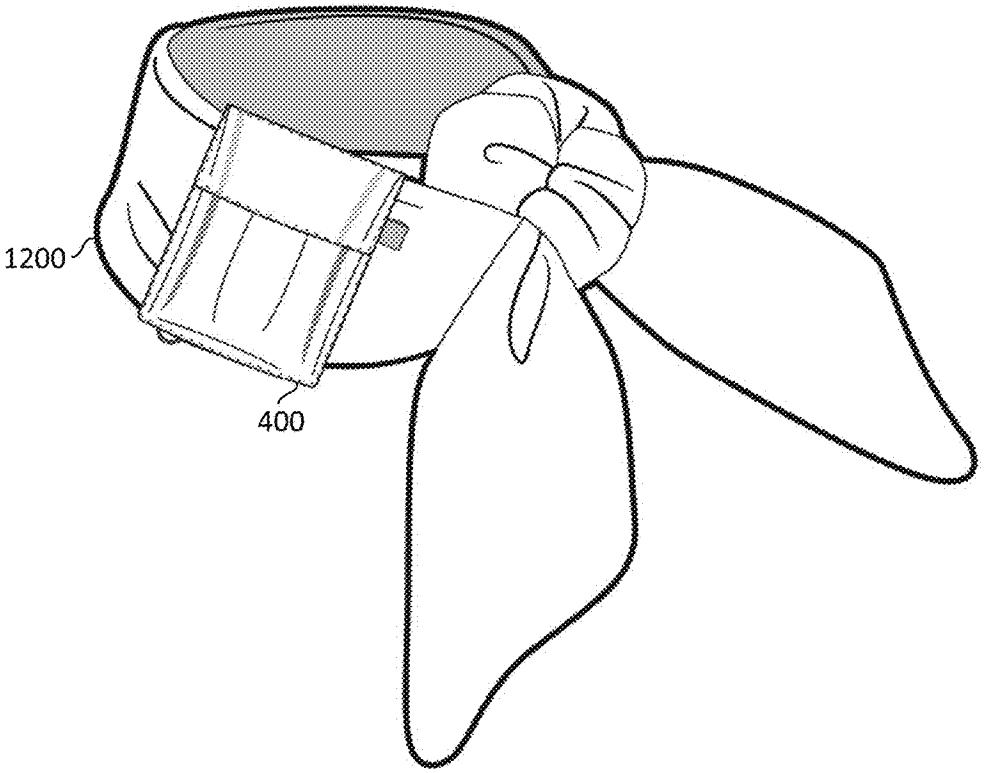
FIG. 12 illustrates an interchangeable pocket attached to a scarf, in accordance with any of the embodiments disclosed herein.

FIG. 12 illustrates an interchangeable pocket 400 attached to a scarf 1200, in accordance with any of the embodiments disclosed herein. Although not visible, the interchangeable pocket 400 may be attached to a pocket base 100 that is attached to the scarf (e.g., in a manner similar to that described above utilizing pins and clasps or in other suitable manner).

Figure 13A:
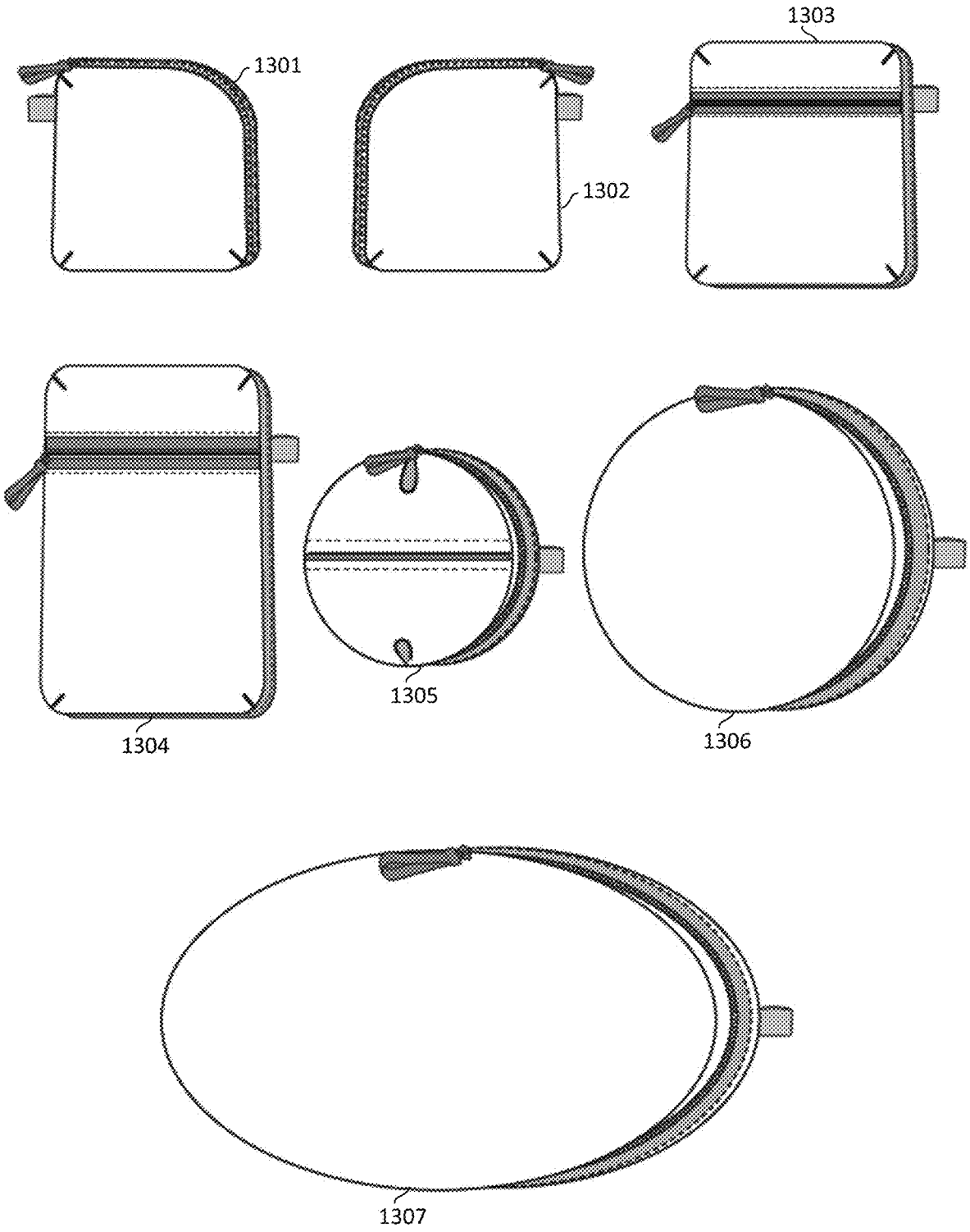
FIGS. 13A-13B illustrate various designs of interchangeable pockets, in accordance with any of the embodiments disclosed herein.
Figure 13B:
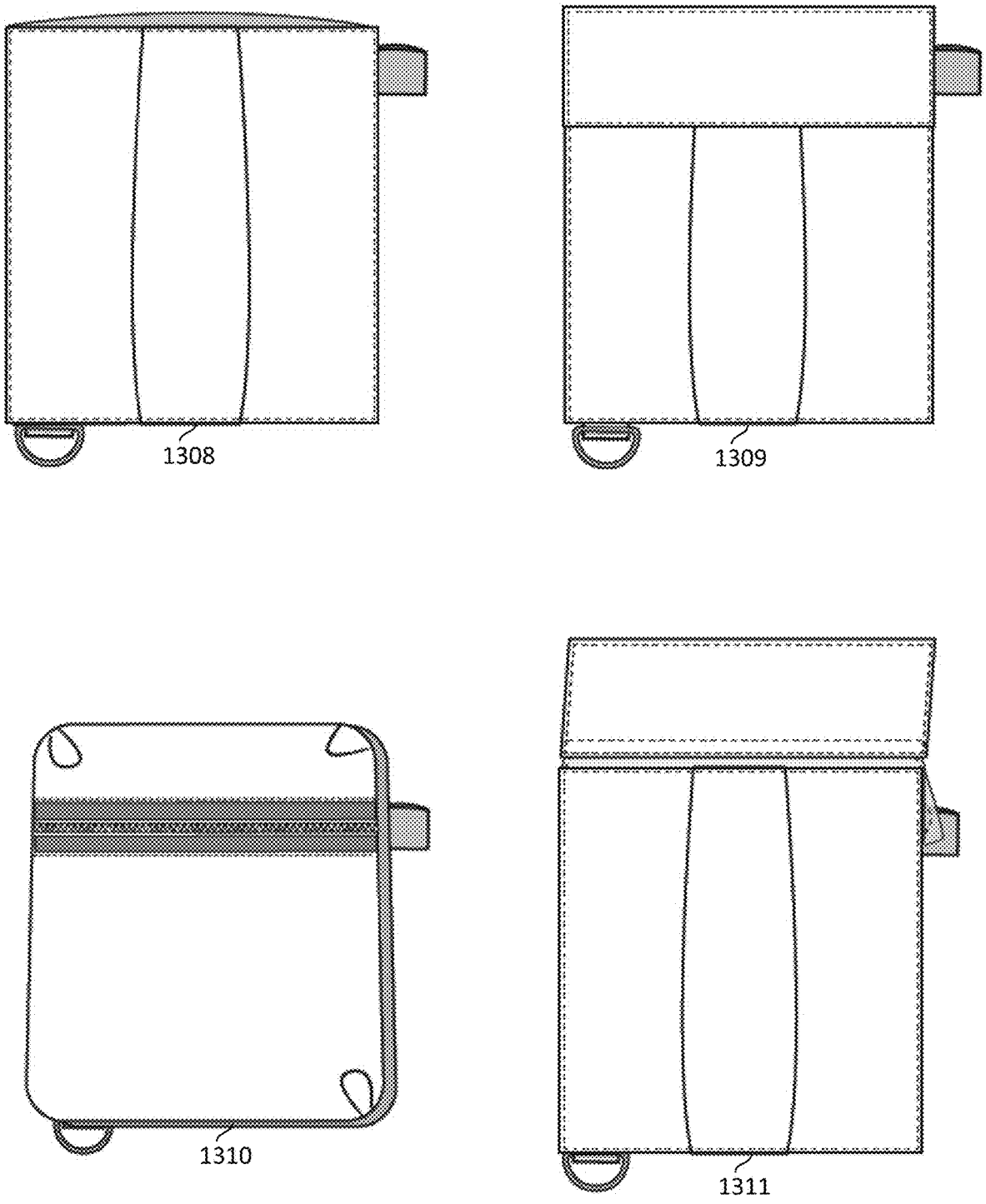

FIGS. 13A-B illustrate various designs of interchangeable pockets 1301-1311, in accordance with any of the embodiments disclosed herein. The pockets may include any suitable style or features. For example, the pockets may be flat, two sided, three sided, etc. In various examples, interchangeable pockets may include a pocket 1308 without a flap that is open at the top, a pocket 1309 with a flap in closed position, pockets 1301-1307 and 1310 with zippers, a pocket 1311 with a flap in an open position, or pockets 1308, 1309, 1311 with pleats.

Figure 14A:
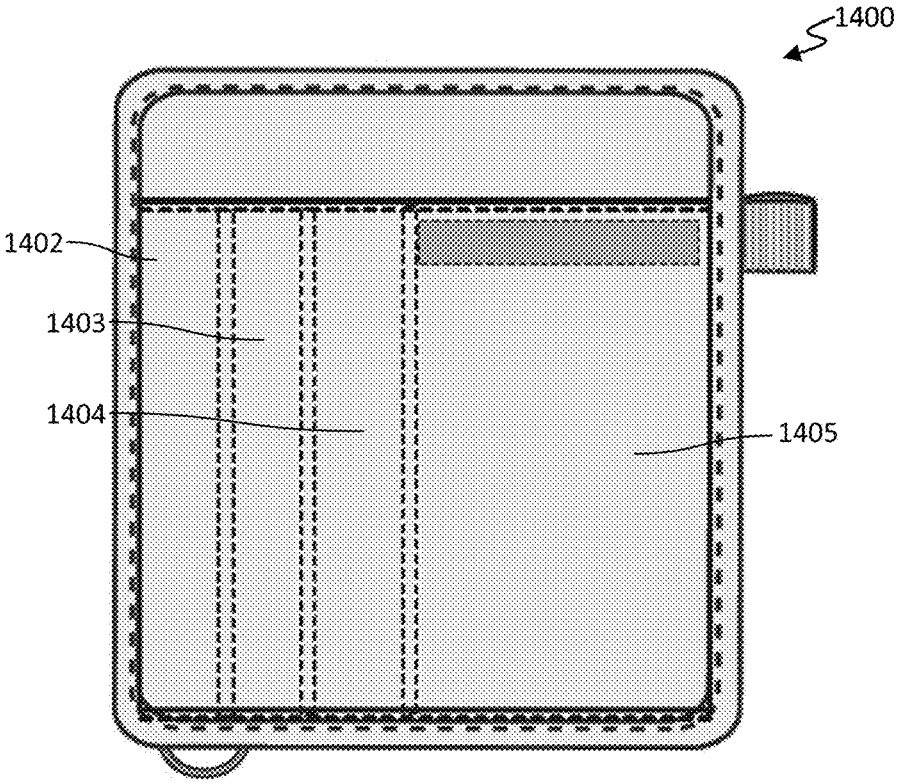
FIGS. 14A-14B illustrate an interchangeable caddy, in accordance with any of the embodiments disclosed herein.
Figure 14B:
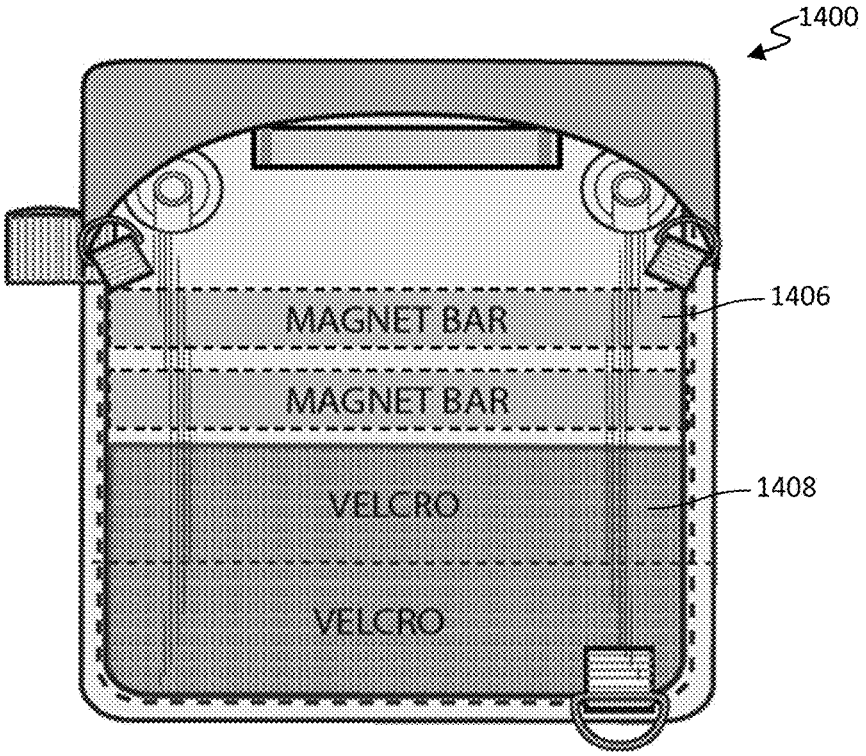

FIGS. 14A and 14B illustrate an interchangeable caddy 1400, in accordance with any of the embodiments disclosed herein. The caddy 1400 may be a type of interchangeable pocket, and may have any suitable characteristics of pocket 400. Accordingly, caddy 1400 may attach to any suitable apparel via a pocket base 100. Caddy 1400 may also provide significant utility when detached from the pocket base 100. In some embodiments, caddy 1400 may be specially adapted for a medical or other office context.

FIG. 14A illustrates a front side of caddy 1400. The front side may include one or more pockets 1402-1404 to hold a writing instrument, such as a pen, pencil, or stylus. The front side may also include a larger pocket 1405 for a larger item, such as a phone.

FIG. 14B illustrates a back side of caddy 1400. In addition to various features described above with respect to pocket 400, the back side may include one or more magnet bars 1406 and/or Velcro strips 1408. Items may be temporarily attached to the backside of the caddy 1400 via the magnet bars 1406 or Velcro strips 1408.

In various embodiments, the caddy 1400 may be constructed of an at least semi-rigid material, so as to provide sufficient support and durability for its functionality.

Figure 15A:
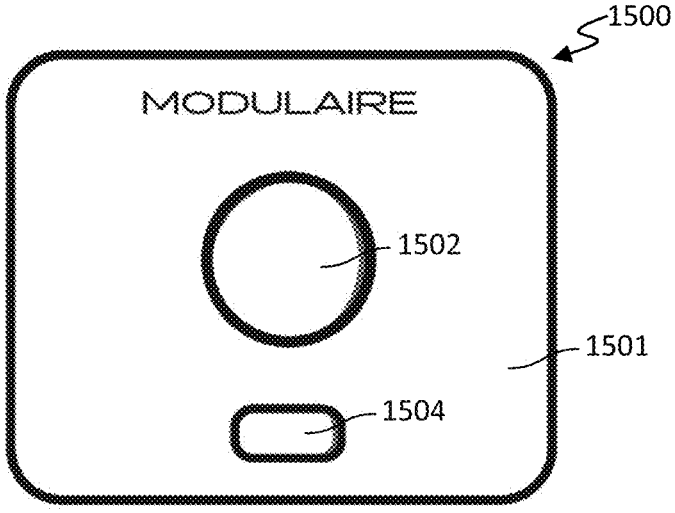
FIGS. 15A-C illustrate a pocket base with a single magnet assembly, in accordance with any of the embodiments disclosed herein.
Figure 15B:
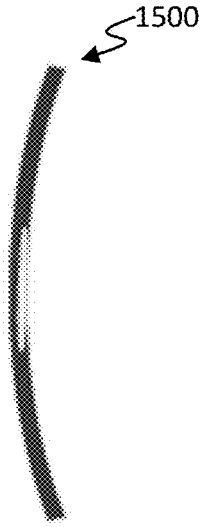
Figure 15C:
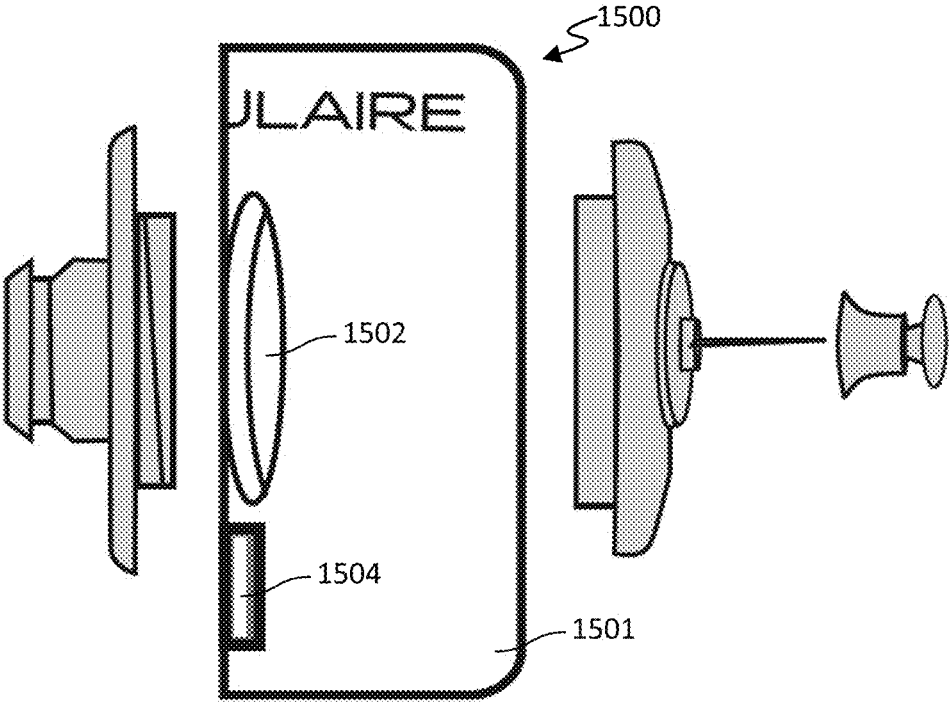

FIGS. 15A-C illustrate a pocket base 1500 with a single magnet assembly, in accordance with any of the embodiments disclosed herein. The pocket base 1500 may have any suitable characteristics of pocket base 100. FIG. 15A illustrates a front view of the pocket base 1500, FIG. 15B illustrates a top view of the pocket base 1500, and FIG. 15C illustrates a side view of the pocket base 1500 with the magnet assembly to be placed through aperture 1502.

While the pocket base 1500 may be attached to any suitable apparel or accessory, in various embodiments, the pocket base 1500 may be particularly suited to be attached to an accessory with a smaller attachment surface, such as a hat, shoe, scarf (and to couple an interchangeable pocket to that accessory in a manner similar to that described above). Because the pocket base 1500 includes a platform 1501 and a single magnet assembly (with a single pin through the material of the item), the pocket base 1500 may be capable of spinning around the item it is attached to.

Figure 16B:
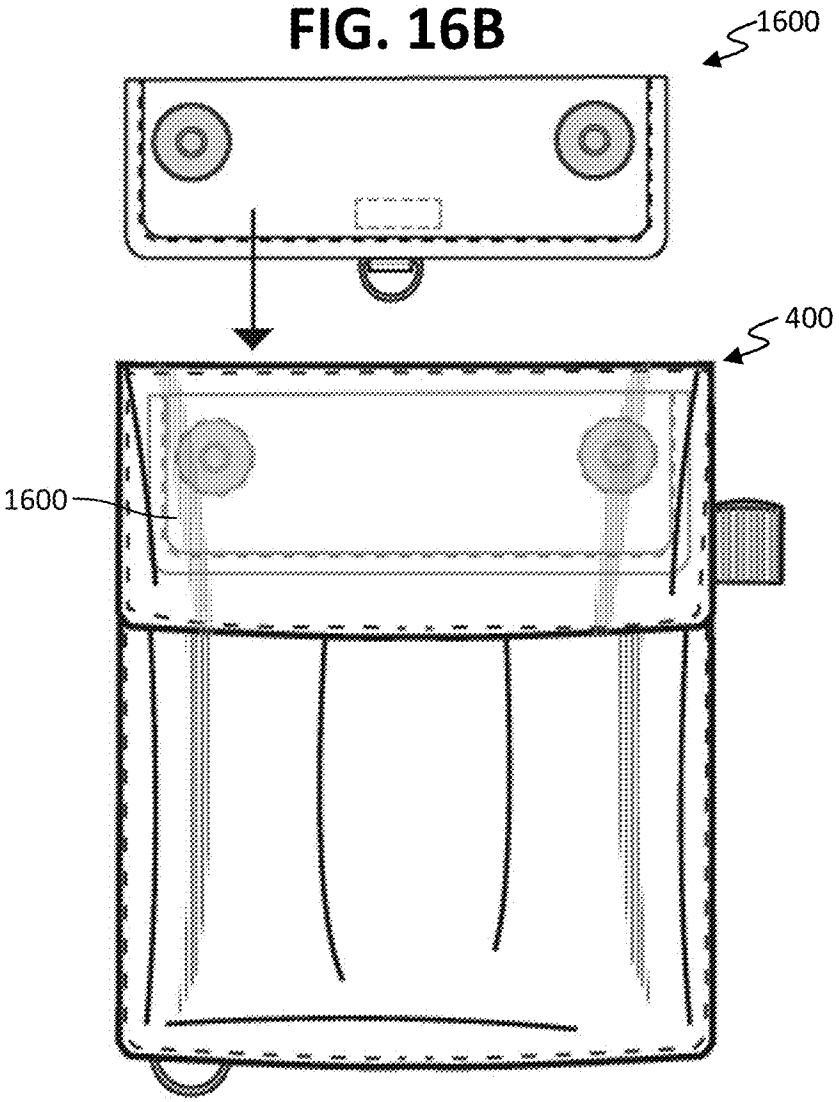
FIGS. 16A-B illustrate a foldable pocket base with dual magnet assemblies, in accordance with any of the embodiments disclosed herein.
Figure 16A:
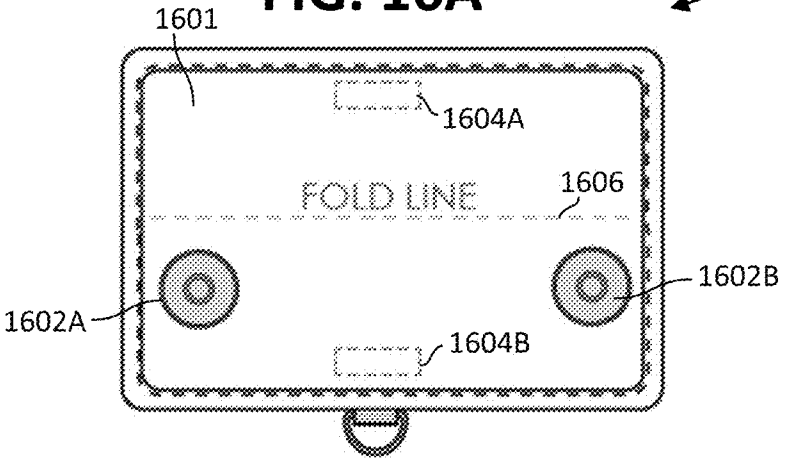

FIG. 16A illustrates a foldable pocket base 1600 with platform 1601 and dual magnet assemblies 1602A and 1602B (which may be similar to or different from any other magnet assemblies described herein), in accordance with any of the embodiments disclosed herein. Pocket base 1600 may have any suitable characteristics of other pocket bases described herein.

When the pocket base 1600 is attached to an item of apparel, the platform 1601 is folded about a fold line 1606 over a portion of the apparel. For example, the platform 1601 could be folded around a belt or scarf or over the top of a waistline. The platform 1601 may be held in the folded position by fastening mechanisms 1604A and 1604B located, e.g., on the back side of the pocket base 1600. In various embodiments, mechanisms 1604A and 1604B may be magnets, although other suitable fastening mechanisms described herein may additionally or alternatively be used.

FIG. 16B illustrates the pocket base 1600 in the folded position as well as an interchangeable pocket 400 attached to the pocket base 1600.

Figure 17B:
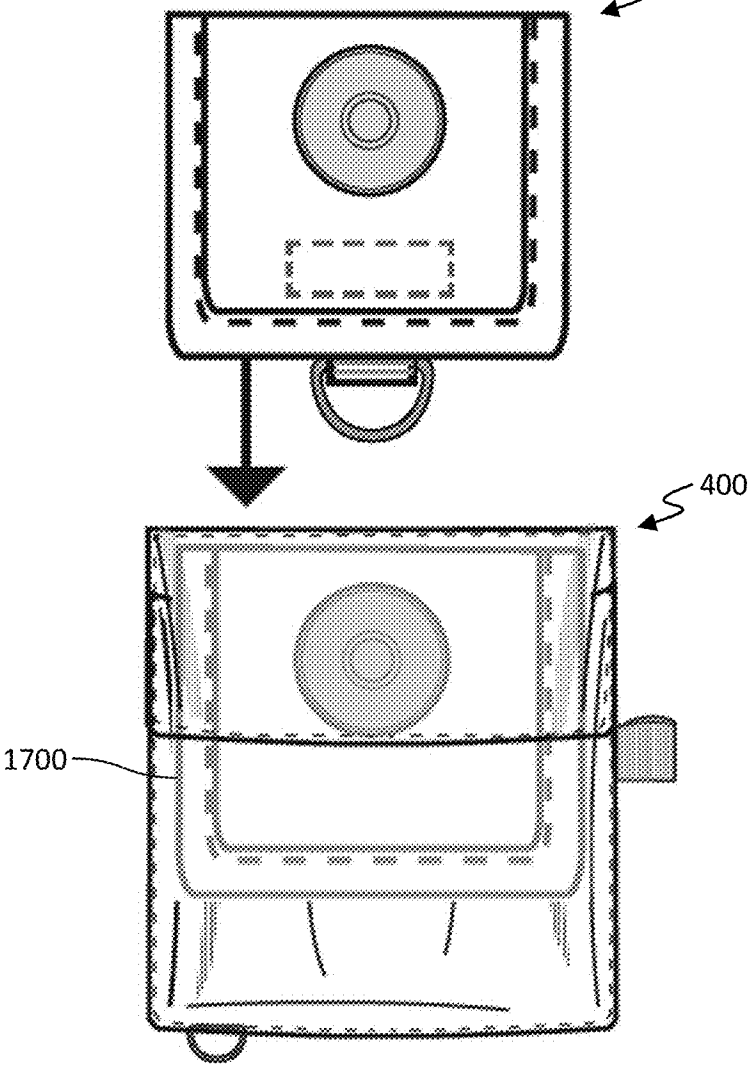
FIGS. 17A-B illustrate a foldable pocket base with a single magnet assembly, in accordance with any of the embodiments disclosed herein.
Figure 17A:
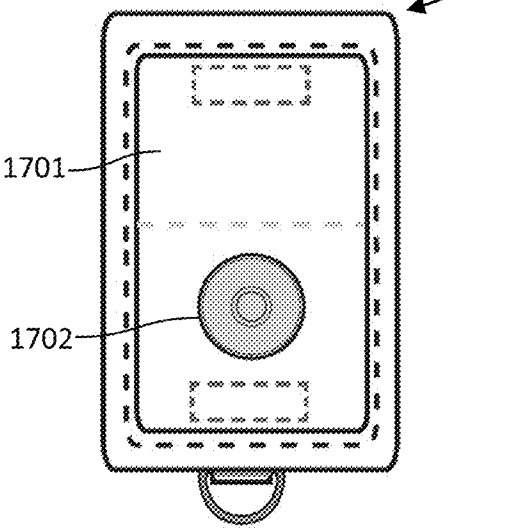

FIG. 17A illustrates a foldable pocket base 1700 with a platform 1701 and single magnet assembly 1702, in accordance with any of the embodiments disclosed herein. The pocket base 1700 may have any suitable characteristics of the other pocket bases described herein.

FIG. 17B illustrates the pocket base 1700 in the folded position as well as an interchangeable pocket 400 attached to the pocket base 1700.

Figure 18:
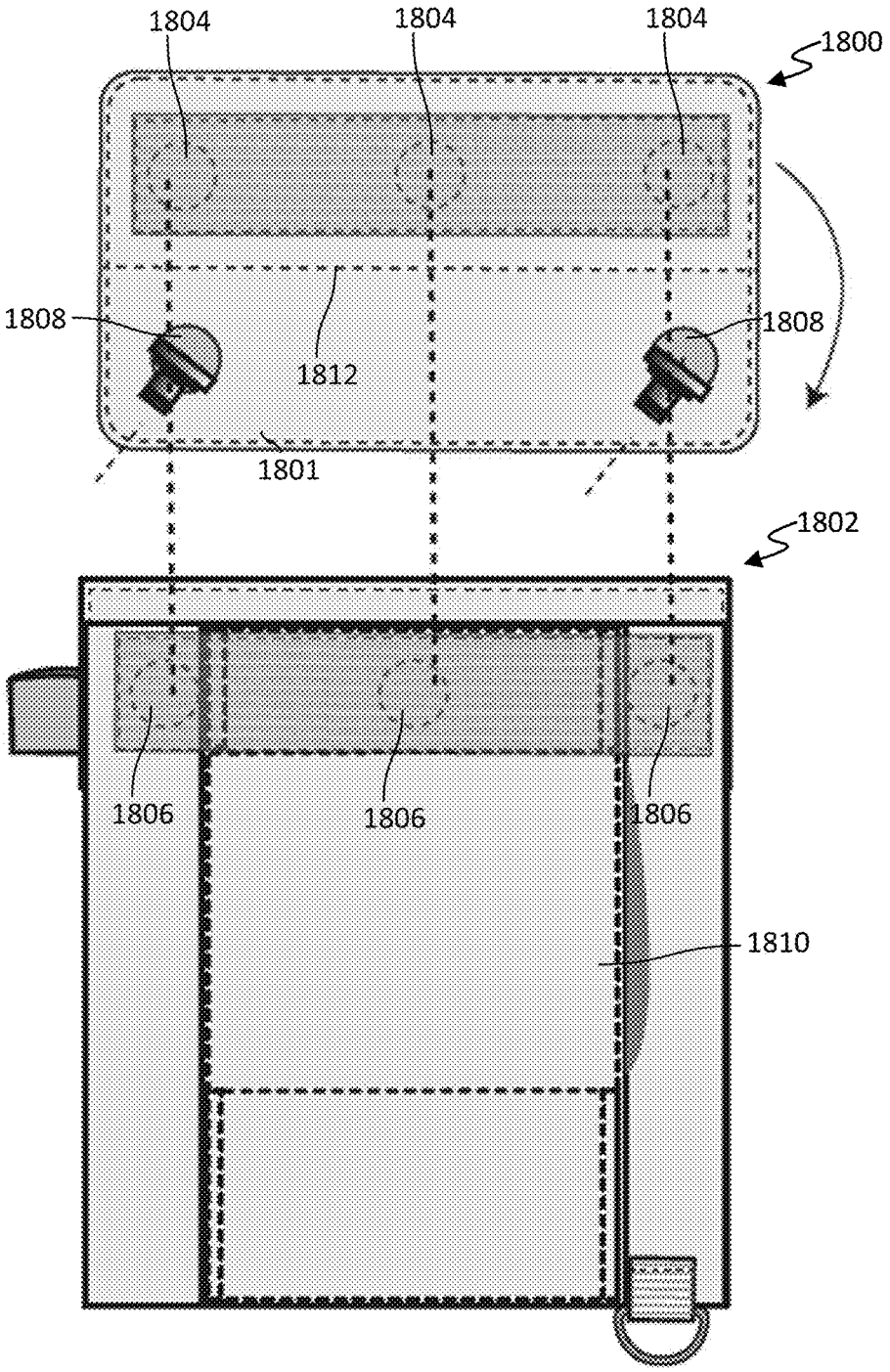
FIG. 18 illustrates a foldable pocket base with a triple magnet assembly, in accordance with any of the embodiments disclosed herein.

FIG. 18 illustrates a foldable pocket base 1800 with a platform 1801 and a triple magnet assembly, in accordance with any of the embodiments disclosed herein. The pocket base 1800 may have any suitable characteristics of other pocket bases described herein. The pocket base includes three magnets 1804 to mate with three magnets 1806 of an interchangeable pocket 1802. The foldable pocket base may also include two fastening elements 1808 (which may have any suitable characteristics of other fastening elements described herein) to be used to attach the pocket base 1800 to an item of apparel or an accessory. The platform 1801 may be folded about a fold line 1812. The interchangeable pocket 1802 may also include a fabric loop 1810 on the back side of the pocket 1802. In various embodiments, the pocket 1802 may be attached to a belt, scarf, or other item independent from a pocket base 1800 by means of the fabric loop 1810 (e.g., by threading the belt or scarf through the fabric loop 1810).

Figure 19A:
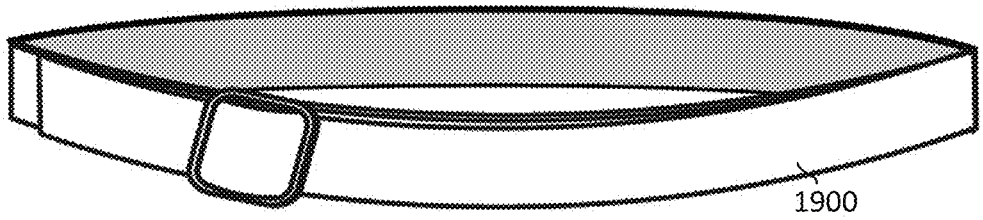
FIGS. 19A-C illustrate a belt, various pocket bases, and various interchangeable pockets, in accordance with any of the embodiments disclosed herein.
Figure 19B:
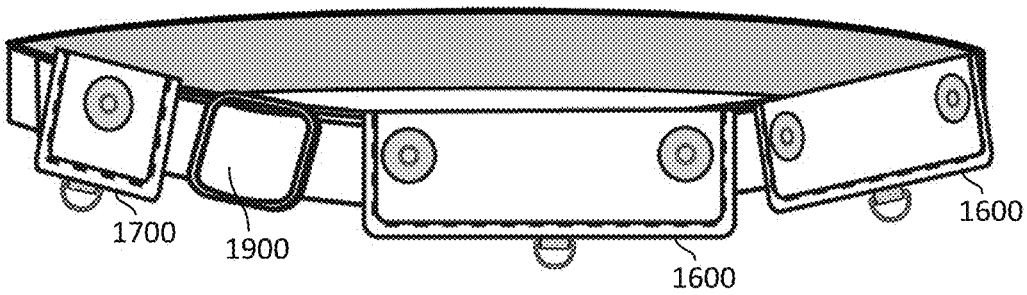
Figure 19C:
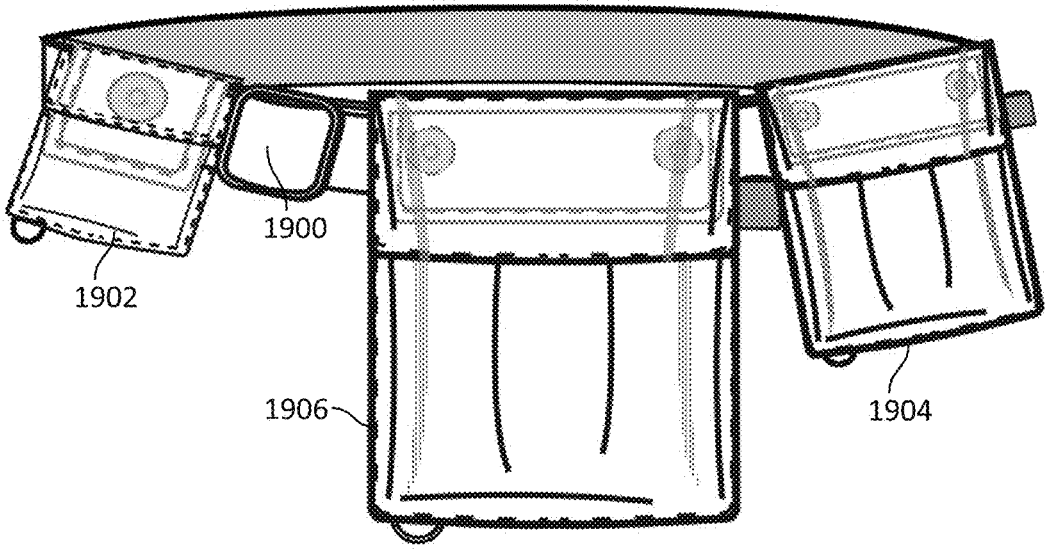

FIGS. 19A-C illustrate a belt 1900, various pocket bases 1600 and 1700, and various interchangeable pockets 1902, 1904, and 1906, in accordance with any of the embodiments disclosed herein. The pocket bases 1600 and 1700 may be attached to the belt by folding the pocket bases around the belt 1900. In various embodiments, portions proximate the bottom of the pocket bases on either side of the fold may be secured to each other (e.g., via magnets or other fastening elements) to secure the pocket bases to the belt. Interchangeable pockets 1902, 1904, and 1906 may then be attached to the belt via the respective pocket bases (e.g., the pockets may have magnets or other fastening elements which interface with corresponding fastening elements of the pocket bases).

Figure 20:
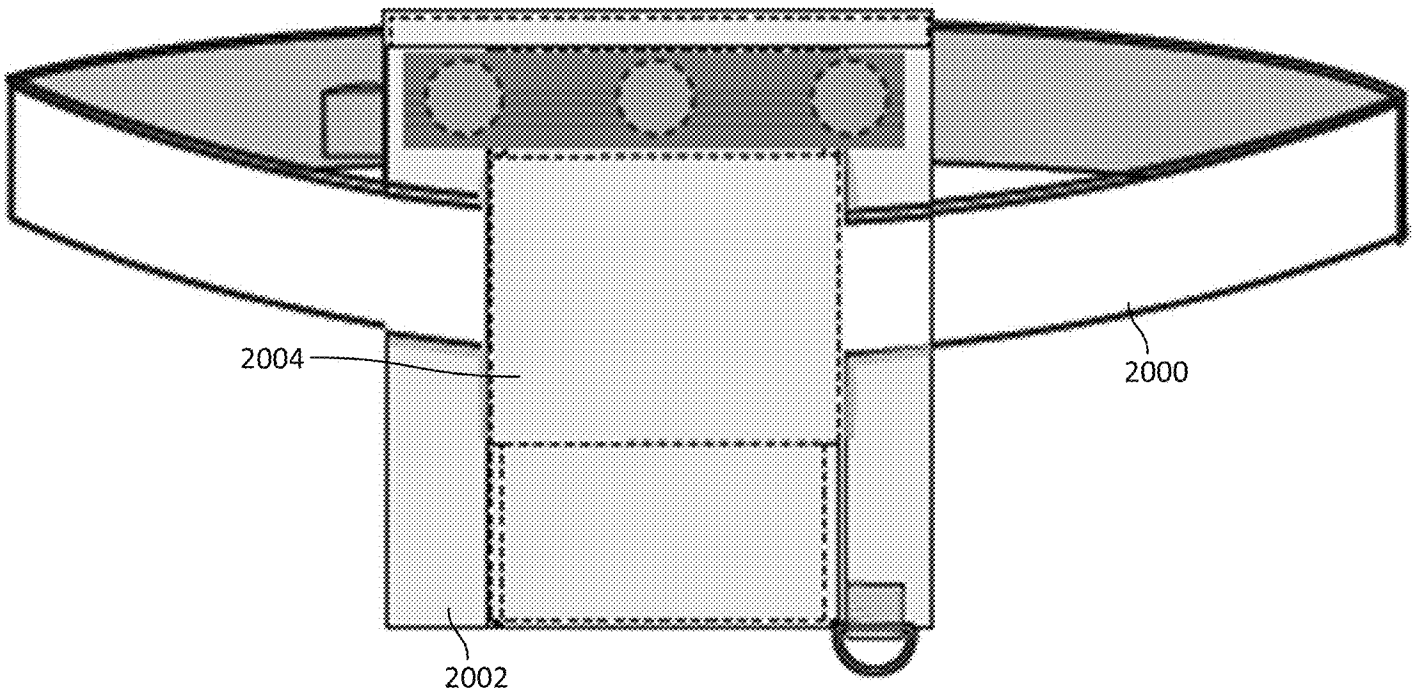
FIG. 20 illustrates a pocket attached to a belt, in accordance with any of the embodiments disclosed herein.

FIG. 20 illustrates an interchangeable pocket 2002 attached to a belt 2000, in accordance with any of the embodiments disclosed herein. In this embodiment, the pocket 2002 is not attached to a pocket base, but rather is attached to the belt through a fabric loop 2004 of the pocket 2002 (e.g., as described above in connection with FIG. 18).

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

It will also be understood that, although the terms "first," "second," and so forth may be used herein to describe various elements, these elements should not be limited by these terms. These terms are only used to distinguish one element from another and are not intended to imply that the objects so described must be in a given sequence, either temporally, spatially, in ranking or in any other manner. For example, a first contact could be termed a second contact, and, similarly, a second contact could be termed a first contact, without departing from the scope of the present example embodiments. The first contact and the second contact are both contacts, but they are not the same contact.

As used in the description of the example embodiments and the appended examples, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. For example, the phrase "A and/or B" means (A), (B), or (A and B), while the phrase "A, B, and/or C" means (A), (B), (C), (A and B), (A and C), (B and C), or (A, B, and C).

The foregoing description, for the purpose of explanation, has been described with reference to specific example embodiments. However, the illustrative discussions above are not intended to be exhaustive or to limit the possible example embodiments to the precise forms disclosed. Many modifications and variations are possible in view of the above teachings. The example embodiments were chosen and described in order to best explain the principles involved and their practical applications, to thereby enable others skilled in the art to best utilize the various example embodiments with various modifications as are suited to the particular use contemplated.

The invention claimed is:

1. An apparatus comprising:

a base comprising:

a platform;

a first fastener to removably couple the platform to a pocket, wherein the first fastener comprises a fastening mechanism on one side and a magnet on a second side, the magnet to mate with a second magnet of the pocket; and a second fastener to removably couple the platform to an item of apparel, wherein the second fastener comprises a fastening mechanism on one side and a pin on a second side, the pin to pass through an item of apparel from an outer surface of the item of apparel to an inner surface of the item of apparel, wherein the second fastener is to interface with the inner surface of the item of apparel to hold at least a portion of the platform against the outer surface of the item of apparel.

2. The apparatus of claim 1, wherein the second fastener comprises a clasp to removably couple to the pin and to be placed on the inner surface of the item of apparel.

3. The apparatus of claim 1, wherein the fastening mechanism of the first fastener is to couple to the fastening mechanism of the second fastener through an aperture in the platform.

4. The apparatus of claim 3, wherein the fastening mechanism of the first fastener comprises first threads and the fastening mechanism of the second fastener comprises second threads, the first threads and the second threads to be screwed together to connect the first fastener to the second fastener through the aperture in the platform.

5. The apparatus of claim 1, wherein the platform exhibits a curvature along an entire length of the platform from a left side to a right side.

6. The apparatus of claim 5, wherein the curvature is such that a shape of the platform is substantially coincident with a portion of a circumference of a circle.

7. The apparatus of claim 1, wherein a top side and a bottom side of the platform are curved, wherein a middle portion of the bottom side exhibits a greatest amount of curvature of the bottom side.

8. The apparatus of claim 1, wherein an average thickness of the platform is between ⅛ inch and ¼ inch.

9. The apparatus of claim 1, wherein the platform is to spin around the item of apparel when coupled to the item of apparel.

10. A system comprising:

a pocket base to removably attach to an item of apparel, wherein the pocket base includes a fastener to interface with an inner surface of the item of apparel to hold at least a portion of the pocket base against an outer surface of the item of apparel, wherein the fastener comprises a fastening mechanism on one side and a pin on a second side, the pin to pass through the item of apparel from the outer surface of the item of apparel to the inner surface of the item of apparel, the fastener further comprising a clasp to removably couple to the pin and to be placed on the inner surface of the item of apparel;

a first pocket to removably attach to the pocket base; and a second pocket to removably attach to the pocket base when the first pocket is not attached to the pocket base.

11. The system of claim 10, wherein the first pocket comprises at least one first magnet concealed within a liner of the first pocket, wherein the at least one first magnet is to interface with at least one second magnet to removably attach the first pocket to the pocket base.

12. The system of claim 10, wherein the first pocket comprises a hood to wrap around a top of the pocket base to conceal at least a portion of the pocket base and to be under tension to pull the pocket base closer to the first pocket.

13. An apparatus comprising:

a pocket to removably attach to a pocket base removably attached to an item of apparel, the pocket base including a fastener to interface with an inner surface of the item of apparel to hold at least a portion of the pocket base against an outer surface of the item of apparel, wherein the fastener comprises a fastening mechanism on one side and a pin on a second side, the pin to pass through the item of apparel from the outer surface of the item of apparel to the inner surface of the item of apparel, the fastener further comprising a clasp to removably couple to the pin and to be placed on the inner surface of the item of apparel, wherein the pocket comprises:

at least one first fastener to removably attach the pocket to the pocket base; and a hood to wrap around a top of the pocket base to conceal at least a portion of the pocket base and to be under tension to pull the pocket base closer to the pocket.

14. The apparatus of claim 13, wherein the hood is sewn onto a back side of the pocket.

15. The apparatus of claim 13, wherein the pocket comprises a pair of dee rings to loop around a belt.

16. The apparatus of claim 13, wherein the pocket comprises a back side with at least one of a hook and loop strip or a magnet bar to couple to an item comprising a corresponding hook and loop strip or magnet bar when the pocket is detached from the pocket base.

17. The apparatus of claim 13, wherein the pocket comprises a first magnet concealed within a liner of the pocket, wherein the first magnet is to interface with a second magnet of the pocket base to removably attach the pocket to the pocket base.

18. The apparatus of claim 17, wherein the first magnet is less than 10 millimeters thick.

19. The apparatus of claim 17, wherein a magnet assembly of the pocket includes a first portion including the first magnet and a second portion, wherein the first portion is attached to the second portion through an aperture in a back side of the pocket.

20. The apparatus of claim 1, further comprising:

a third fastener to removably couple the platform to a pocket, wherein the third fastener comprises a fastening mechanism on one side and a third magnet on a second side, the third magnet to mate with a fourth magnet of the pocket; and a fourth fastener to removably couple the platform to the item of apparel, wherein the fourth fastener comprises a fastening mechanism on one side and a pin on a second side, the pin of the fourth fastener to pass through the item of apparel from the outer surface to the inner surface of the item of apparel, wherein the fourth fastener is to interface with the inner surface of the item of apparel to hold at least a portion of the platform against the outer surface of the item of apparel.

* * * * *